US007210466B1

(12) United States Patent
Roche

(10) Patent No.: US 7,210,466 B1
(45) Date of Patent: May 1, 2007

(54) PURGE VALVE AND VAPOR CONTROL SYSTEM

(75) Inventor: Ronald H. Roche, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 82 days.

(21) Appl. No.: 10/996,495

(22) Filed: Nov. 23, 2004

(51) Int. Cl.
*F02M 33/02* (2006.01)

(52) U.S. Cl. ..... 123/519; 123/520

(58) Field of Classification Search ..... 123/516, 123/518, 519, 520; 137/510; 251/61.1, 251/118
See application file for complete search history.

(56) References Cited

U.S. PATENT DOCUMENTS 3,752,134 A * 8/1973 Hollis, Jr. ..... 123/520
3,913,545 A * 10/1975 Haase et al. ..... 123/520
3,935,850 A * 2/1976 King ..... 123/520
4,044,743 A * 8/1977 Eaton ..... 123/520
4,086,897 A * 5/1978 Tamura et al. ..... 123/520
4,127,097 A * 11/1978 Takimoto ..... 123/520
4,153,025 A * 5/1979 Thornburgh ..... 123/520
4,193,383 A * 3/1980 Rogers ..... 123/520
4,212,276 A * 7/1980 Kaneda ..... 123/519
4,308,841 A * 1/1982 Kingsley ..... 123/520
4,326,489 A * 4/1982 Heitert ..... 123/520
4,700,683 A * 10/1987 Uranishi et al. ..... 123/519
4,741,317 A * 5/1988 Yost ..... 123/520
5,054,508 A * 10/1991 Benjey ..... 137/43
5,069,188 A * 12/1991 Cook ..... 123/520
5,099,880 A * 3/1992 Szlaga et al. ..... 137/587
5,409,035 A * 4/1995 Scott et al. ..... 137/510
5,448,981 A * 9/1995 Cook et al. ..... 123/520
5,529,280 A * 6/1996 Satoh et al. ..... 251/61.1
5,640,993 A 6/1997 Kasugai et al.
5,941,218 A * 8/1999 DeLand et al. ..... 123/520
6,003,499 A * 12/1999 Devall et al. ..... 123/520
6,058,970 A * 5/2000 Osaki et al. ..... 137/587
6,119,661 A 9/2000 DeLand et al.
6,786,227 B2 * 9/2004 Weldon et al. ..... 137/14

* cited by examiner

*Primary Examiner*—Thomas Moulis
(74) *Attorney, Agent, or Firm*—Reising, Ethington, Barnes, Kisselle, P.C.

(57) ABSTRACT

A vapor control system includes a vapor receiver having an inlet through which vapor is received, an outlet through which vapor is discharged, and a control valve having a first inlet in communication with the outlet of the fuel receiver, a second inlet in communication with a pressure source and an outlet. The control valve also includes a valve having a closure moveable between a first position, preventing communication between the first inlet and the outlet, and a second position permitting communication between the first inlet and the outlet in response to a pressure signal over a threshold pressure provided from the pressure source through the second inlet. Movement of the closure to its second position permits routing of vapor from the vapor receiver, through the first inlet and out of the outlet of the control valve.

28 Claims, 1 Drawing Sheet

PURGE VALVE AND VAPOR CONTROL SYSTEM

FIELD OF THE INVENTION

The present invention relates generally to fuel systems and more particularly to a purge valve and vapor control system for use in a fuel system.

BACKGROUND OF THE INVENTION

Increasingly strict environmental regulations are being promulgated by governmental agencies, including regulations restricting the emission to atmosphere of hazardous hydrocarbon fuel vapors. Such regulations are becoming increasingly common with respect to machines having small engines including both handheld and ground supported machines such as lawnmowers, leaf blowers, weed trimmers, power washers and the like.

To facilitate compliance with these regulations, various fuel vapor control systems and methodologies have been employed. For example, a carbon canister may be employed to receive fuel vapor from a fuel system, such as from a fuel tank, and to collect and hold the fuel vapor prior to it being purged to an intake manifold of the engine for combustion in the engine. During hot soak conditions, such as when a hot engine is shut off or a vehicle engine is exposed to hot ambient conditions for an extended period of time, fuel vapor generation may be sufficient to saturate or overload the fuel vapor canister. Once saturated or overloaded, the vapor canister is no longer effective. Passively purged vapor canisters may vent to the atmosphere excess fuel vapor which results in unacceptably high hydrocarbon fuel vapor emission to the atmosphere.

SUMMARY OF THE INVENTION

A vapor control system includes a vapor receiver having an inlet through which vapor is received, an outlet through which vapor is discharged, and a control valve having a first inlet in communication with the outlet of the vapor receiver, a second inlet in communication with a pressure source and an outlet. The control valve also includes a valve having a closure moveable between a first position preventing communication between the first inlet and the outlet, and a second position permitting communication between the first inlet and the outlet in response to a pressure signal over a threshold pressure provided from the pressure source through the second inlet. Movement of the closure to its second position permits routing of vapor from the vapor receiver, through the first inlet and out of the outlet of the control valve.

Desirably, in one presently preferred implementation, the pressure source is an intake manifold of an engine and the outlet of the control valve is also communicated with the intake manifold so that when the valve head is moved towards its second position, fuel vapor can be purged from the vapor receiver and delivered to the intake manifold of the engine for combustion therein. The closure preferably is carried by a flexible diaphragm actuated by change in pressure in the intake manifold which is communicated to the diaphragm through the second inlet. In this manner, the threshold pressure at which the closure and diaphragm are moved may be a function of the surface areas of the diaphragm exposed to the intake manifold pressure on opposed sides of the diaphragm.

Some of the objects, features and advantages that may be achieved by at least some embodiments of the present invention include providing a vapor control system that reduces emission to atmosphere of hydrocarbon fuel vapor, actively purges a vapor canister, provides a mechanical actuation and initiation of the canister purge cycle, does not require electricity, does not interfere with steady operation or acceleration of the engine, preferably operates only during deceleration of the engine when the vacuum in the inlet manifold is highest, operates during the frequent excursions of the throttle during normal governor operation, is of relatively simple design and economical manufacture and assembly, and has a long, useful life in service.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF THE PREFERRED EMBODIMENTS

Figure 1:
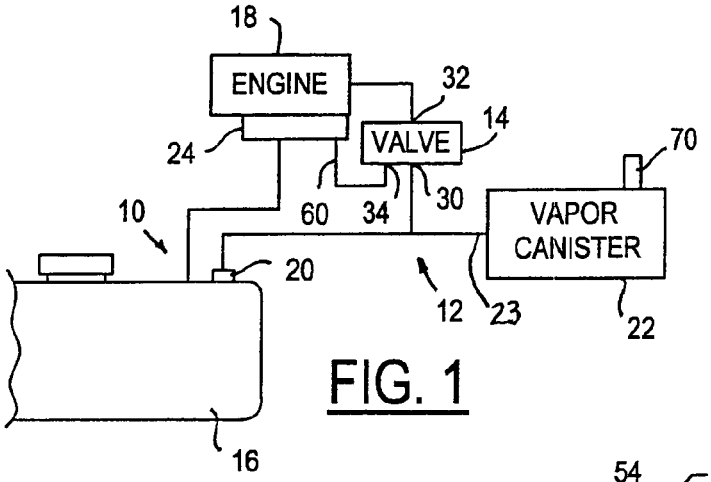
FIG. 1 is a schematic view of a vapor control system according to one presently preferred embodiment of the invention.

Referring in more detail to the drawings, FIG. 1 illustrates a fuel system 10 including a vapor control system 12 and vapor purge valve 14 according to one presently preferred embodiment of the present invention. The fuel system 10 includes a fuel tank 16 that contains a supply of liquid fuel to support operation of an engine 18. Gaseous phase fluids, including fuel vapors, are also contained within the fuel tank 16, and may be vented through an appropriate valve or outlet 20 to, for example, a vapor receiver such as a vapor canister 22. The vapor canister has a passage 23 through which vapor is received, and through which vapor may also be purged or discharged from the vapor canister 22. So in this embodiment, the passage 23 acts as an inlet and an outlet. If desired, the vapor canister 22 may include a separate outlet so that the passage 23 acts as an inlet and vapor would then be purged through the separate outlet. The vapor canister 22 usually includes a filter, or filter material like activated carbon to "hold" the vapor (hydrocarbon) thus allowing only the hydrocarbon-free product to the atmosphere through a vent 70 in the vapor canister 22. The hydrocarbons are purged from the vapor canister 22 through the valve 14 to an intake manifold 24 of the engine 18 for combustion in the engine.

Figure 2:
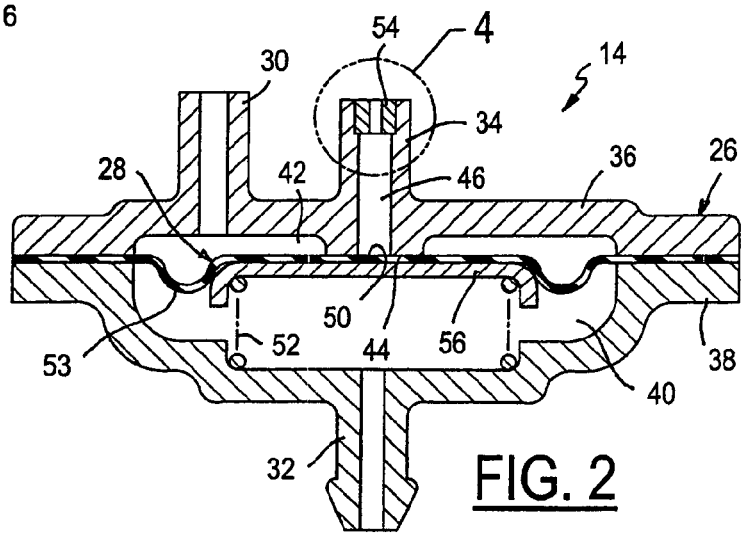
FIG. 2 is an enlarged sectional view of a mechanical purge valve according to one aspect of the present invention illustrated in a first or closed position.
Figure 3:
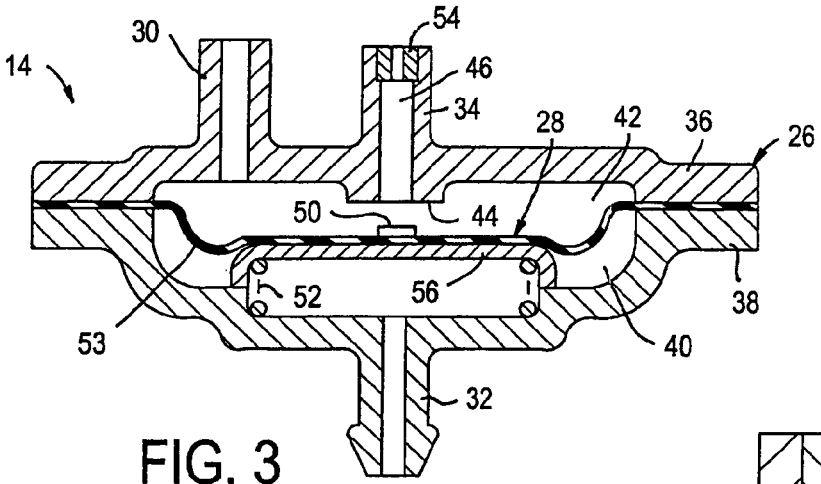
FIG. 3 is a sectional view of the purge valve of FIG. 2 illustrated in a second or open position and with a modified closure.

As best shown in FIGS. 2 and 3, the purge valve 14 is preferably interposed between the fuel tank 16 and the vapor canister 22 to control venting or purging of the vapor canister 22. The purge valve 14 includes a body 26, a pressure responsive member 28 carried by the body 26, first and second inlets 30, 32, and an outlet 34. The pressure responsive member is preferably a flexible diaphragm 28 trapped about its periphery between two portions 36, 38 of the valve body 26. On one side, the diaphragm 28 defines part of a pressure signal chamber 40 with one of the valve body portions 38, and on its other side defines part of a chamber 42 into which the first inlet 30 and outlet 34 extend. A valve seat 44 is provided in the chamber 42 preferably adjacent to the outlet 34 and defines part of a passage 46 of the outlet 34.

To close the outlet 34 and prevent purging or venting of the vapor canister 22 therethrough, the diaphragm 28, or a valve head or closure 50 carried by the diaphragm 28, preferably engages the valve seat 44 to at least substantially inhibit fluid flow therethrough. The closure 50 may be separate from, connected to or carried by (as shown in FIG. 3), or part of or integral with the diaphragm 28. When the closure 50 is engaged with the valve seat 44, the valve 14 is in its first or closed position and communication between the first inlet 30 and the outlet 34 is at least substantially prevented. Preferably, to yieldably bias the diaphragm 28 to its first position, a biasing member, such as a spring 52, is disposed in the pressure signal chamber 40 and acting on the diaphragm 28. The diaphragm 28 may have one or more convolutions 53 to increase the flexibility and range of movement of the diaphragm 28 in use.

Figure 4:
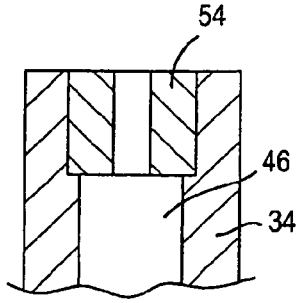
FIG. 4 is an enlarged fragmentary sectional view illustrating a portion of an outlet of the purge valve.

As best shown in FIG. 3, the diaphragm 28 is moveable away from the valve seat 44 to a second or open position wherein the first inlet 30 is communicated with the outlet 34. In this position, the vapor canister 22 is communicated with the outlet 34 to permit venting or purging of the vapor canister 22. As best shown in FIG. 4, a jet or orifice 54 may be disposed in the outlet 34 to control the fluid flow rate therethrough.

Desirably, the second inlet 32 is communicated with the intake manifold 24, to provide a pressure signal in the pressure signal chamber 40 that acts on an effective surface area of the diaphragm 28 exposed to the pressure signal chamber. The effective surface may include areas of the diaphragm directly exposed to the chamber 40 and, for example, the exposed area of a retainer 56 disposed between the diaphragm 28 and the spring 52. The outlet 34 preferably also is communicated with the intake manifold 24 of the engine 18 such as through a suitable conduit 60 providing a pressure signal through the orifice 54 and outlet passage 46 acting on the diaphragm 28 in an area bounded by the valve seat 44. In this embodiment, the effective surface area of the diaphragm 28 exposed in the pressure signal chamber 40 preferably is greater than the surface area bounded by the valve seat 44. Accordingly, the intake manifold pressure signal as applied to the opposed sides of the diaphragm 28 provides a net force tending to displace the diaphragm 28 away from the valve seat 44. The valve 14 can be calibrated to move between its first and second positions by, for example, communicating the pressure signal chamber 40 and chamber 42 with different locations in the intake manifold that have different pressure values or ranges, and based on the size of the orifice 54 and the force of the spring 52 provided on the diaphragm 28. In one implementation, the chamber 40 is communicated with a high-pressure differential area of the intake manifold and the chamber 42 is communicated with a lower pressure differential area of the intake manifold.

Preferably, the purge valve 14 is used with a speed controlled or governed vehicle that varies its throttle position in an effort to maintain a desired or preset engine speed. As the engine 18 decelerates, an at least momentary increase in vacuum pressure in the intake manifold 24 is communicated to the purge valve 14 through the outlet 34 and the second inlet 32. When the pressure signal is above a threshold value, the diaphragm 28 is moved to its second position with the closure 50 removed from the valve seat 44 permitting communication between the first inlet 30 and the outlet 34. Therefore, the vapor canister 22 can be purged of fuel vapor through the first inlet 30, and discharged from the purge valve 14 through the outlet 34 to the intake manifold 24 for combustion in the engine 18. During this activity, fresh air is vented into the vapor canister 22 through the atmospheric vent 70.

The flow rate of fluid from the vapor canister 22 and to the engine 18 through the purge valve 14 is controlled by the size of the orifice 54 in the outlet passage 46. Desirably, this avoids undo engine instability due to the varied ratio of air and fuel delivered to the engine 18 while purging or venting the vapor canister 22. Also, by purging the vapor canister 22 as the engine 18 decelerates or a throttle valve (not shown) is closed in a governed or speed controlled engine, the instability due to the varied air to fuel ratio can be minimized since variation in the air to fuel ratio is most tolerable during engine deceleration or throttle closing wherein the engine fuel demand is less than, for example, during engine acceleration.

Desirably, the purging of the vapor canister 22 occurs mechanically, without electricity, and is automatic in response to a suitable pressure signal from the intake manifold 24. The purge valve 14 itself could be mounted on the vapor canister 22, the engine 18, fuel tank 16, or any other suitable location.

While certain preferred embodiments have been shown and described, persons of ordinary skill in this art will readily recognize that the preceding description has been set forth in terms of description rather than limitation, and that various modifications and substitutions can be made without departing from the spirit and scope of the invention. By way of example without limitation, the closure 50 may be integral with the diaphragm 28, or coupled to, carried by or otherwise responsive to diaphragm movement to move the closure 50 relative to the valve seat 44 as desired. Also, the vapor canister may have a separate inlet and outlet, the inlet and outlet may be combined in one passage with in-flow and out-flow at different times, or the flow and passages in the vapor canister may be otherwise arranged as desired. Of course, still other modifications and substitutions can be made. The invention is defined by the following claims.

The invention claimed is:

1. A vapor control system, comprising:

a vapor receiver having an inlet through which fluid is received and an outlet through which fluid is discharged;

a control valve having a first inlet in communication with the outlet of the vapor receiver, a second inlet in communication with a pressure source, an outlet communicated with a pressure source and a closure movable between a first position preventing communication between the first inlet and the outlet and a second position permitting communication between the first inlet and the outlet in response to a pressure signal over a threshold pressure provided from the pressure source through the second inlet, and a pressure signal chamber in communication with the pressure source through the second inlet, wherein the pressure signal chamber is communicated with a higher pressure differential source than the outlet.

2. The vapor control system of claim 1 wherein the pressure source is an intake manifold of an engine with which the vapor control system is used, and wherein the pressure signal chamber is communicated with a high-pressure differential area of the intake manifold and the outlet is communicated with a lower pressure differential area of the intake manifold.

3. The vapor control system of claim 1 wherein the outlet is communicated with an intake manifold of an engine so that when the closure is not in its first position fuel vapor in the vapor receiver is caused to move through the control valve and to the intake manifold to purge the vapor receiver.

4. The vapor control system of claim 1 wherein the vapor receiver includes a vapor canister including filter material adapted to remove hydrocarbon fuel vapors from fluid received therein.

5. The vapor control system of claim 1 wherein the closure is carried by a flexible diaphragm that is moved in response to pressure above a threshold pressure at the second inlet.

6. The vapor control system of claim 5 which also includes a valve seat between the first inlet and the outlet and wherein the closure engages the valve seat when the valve head is in its first position to at least substantially inhibit fluid communication between the first inlet and the outlet.

7. The vapor control system of claim 6 wherein the diaphragm defines in part the pressure signal chamber and the threshold pressure is a function of the surface area of the closure bounded by the valve seat and the surface area of the diaphragm exposed to the pressure signal chamber.

8. The vapor control system of claim 1 wherein the closure is yieldably biased toward its first position.

9. The vapor control system of claim 5 wherein the diaphragm is yieldably biased in a direction moving the valve head to its first position.

10. The vapor control system of claim 1 wherein the pressure source provides a subatmospheric pressure to the second inlet.

11. The vapor control system of claim 1 wherein the inlet of the vapor receiver and the outlet of the vapor receiver are defined by the same passage.

12. A vapor control system, comprising:

a vapor receiver having an inlet through which vapor is received and an outlet through which vapor is discharged;

a control valve having a first inlet in communication with the outlet of the vapor receiver, a second inlet in communication with a pressure source, an outlet in communication with the pressure source, a pressure responsive member disposed between the second inlet and the outlet and a closure responsive to movement of the pressure responsive member for movement of the closure between a first position preventing communication between the first inlet and the outlet and a second position permitting communication between the first inlet and the outlet in response to a pressure signal over a threshold pressure provided from the pressure source through the second inlet and acting on the pressure responsive member to permit routing of vapor from the vapor receiver, through the first inlet and out of the outlet of the control valve and wherein the pressure responsive member is acted on by the pressure source through the outlet and by the pressure source through the second inlet and the second inlet is communicated with a higher pressure differential source than the outlet.

13. The vapor control system of claim 12 wherein the pressure source provides a subatmospheric pressure signal to the second inlet.

14. The vapor control system of claim 12 wherein the pressure source is an intake manifold of an engine with which the vapor control system is used, and wherein the second inlet is communicated with a high-pressure differential area of the intake manifold and the outlet is communicated with a lower pressure differential area of the intake manifold.

15. The vapor control system of claim 12 wherein the vapor receiver includes a vapor canister including activated carbon adapted to remove hydrocarbon fuel vapors from vapors received therein.

16. The vapor control system of claim 12 wherein the pressure responsive member is a flexible diaphragm that is moved in response to pressure at the second inlet above a threshold pressure and the closure is carried by the diaphragm.

17. The vapor control system of claim 16, which also includes a valve seat between the first inlet and the outlet and wherein the closure engages the valve seat when the closure is in its first position to at least substantially inhibit vapor communication between the first inlet and the outlet.

18. The vapor control system of claim 17 wherein the diaphragm defines in part a pressure chamber and the threshold pressure is a function of the surface area of the closure bounded by the valve seat and the surface area of the diaphragm exposed to the pressure chamber.

19. The vapor control system of claim 12 wherein the closure is yieldably biased toward its first position.

20. The vapor control system of claim 16 wherein the diaphragm is yieldably biased in a direction moving the closure to its first position.

21. The vapor control system of claim 12 wherein the inlet of the vapor receiver and the outlet of the vapor receiver are defined by the same passage.

22. A control valve for a vapor control system, comprising:

a housing having a first inlet arranged for communication with a vapor source, a second inlet arranged for communication with a pressure source, and an outlet communicated with the pressure source;

a pressure responsive member carried by the housing between the second inlet and the outlet and movable between first and second positions in response to a pressure signal above a threshold pressure at the second inlet; and a closure movable in response to movement of the pressure responsive member between a first position preventing communication between the first inlet and the outlet and a second position permitting communication between the first inlet and the outlet to permit vapor flow between the vapor source and the outlet and wherein the pressure responsive member is acted on by the pressure source through the outlet and by the pressure source through the second inlet and the second inlet is communicated with a higher pressure differential source than the outlet.

23. The control valve of claim 22 wherein the pressure responsive member is a flexible diaphragm that is moved in response to a pressure at the second inlet above a threshold pressure and the closure is carried by the diaphragm.

24. The control valve of claim 23, which also includes a valve seat between the first inlet and the outlet and wherein the closure engages the valve seat when the closure is in its first position to at least substantially inhibit vapor communication between the first inlet and the outlet.

25. The control valve of claim 24 wherein the diaphragm defines in part a pressure chamber and the threshold pressure is a function of the surface area of the closure bounded by the valve seat and the surface area of the diaphragm exposed to the pressure chamber.

26. The control valve of claim 22 wherein the closure is yieldably biased toward its first position.

27. The control valve of claim 23 wherein the diaphragm is yieldably biased in a direction moving the closure to its first position.

28. The control valve of claim 22 wherein the closure is carried by the pressure responsive member.

* * * * *